US007527177B2

(12) United States Patent
Garcia et al.

(10) Patent No.: US 7,527,177 B2
(45) Date of Patent: May 5, 2009

(54) FLUID DISPENSER MEMBER

(75) Inventors: Firmin Garcia, Evreux (FR); Frédéric Duquet, Thibouville (FR)

(73) Assignee: Valois S.A.S., Le Neubourg (FR)

( * ) Notice: Subject to any disclaimer, the term of this patent is extended or adjusted under 35 U.S.C. 154(b) by 639 days.

(21) Appl. No.: 11/018,829

(22) Filed: Dec. 22, 2004

(65) Prior Publication Data

US 2005/0135951 A1 Jun. 23, 2005

Related U.S. Application Data

(60) Provisional application No. 60/561,510, filed on Apr. 13, 2004.

(30) Foreign Application Priority Data

Dec. 22, 2003 (FR) ..... 03 15194

(51) Int. Cl.
*B65D 88/54* (2006.01)

(52) U.S. Cl. ..... 222/321.2; 222/321.3; 222/321.7; 222/321.9; 222/383.1; 239/333

(58) Field of Classification Search ..... 222/321.2, 222/321.3, 321.9, 380, 383.1
See application file for complete search history.

(56) References Cited

U.S. PATENT DOCUMENTS

| | | | | |
|---|---|---|---|---|
| 4,050,613 | A | | 9/1977 | Corsette |
| 4,079,865 | A | | 3/1978 | Kutik |
| 4,111,367 | A | | 9/1978 | Hayes |
| 4,361,255 | A | * | 11/1982 | Saito et al. ..... 222/321.2 |
| 4,369,900 | A | | 1/1983 | Saito et al. |
| 4,494,680 | A | | 1/1985 | Corsette |
| 5,388,766 | A | | 2/1995 | Buisson |
| 5,938,084 | A | | 8/1999 | Fuchs et al. |
| 5,947,340 | A | | 9/1999 | Arnold et al. |
| 7,014,069 | B2 | | 3/2006 | Crosnier et al. |
| 2002/0047025 | A1 | | 4/2002 | Ray |
| 2005/0133534 | A1 | | 6/2005 | Garcia |

FOREIGN PATENT DOCUMENTS

| | | |
|---|---|---|
| DE | 39 28 521 A1 | 3/1991 |
| FR | 2 742 812 A1 | 6/1997 |
| GB | 2 004 585 A | 4/1979 |
| WO | 02/96776 AL | 5/2002 |

OTHER PUBLICATIONS

Search Report for FR 0315193 dated Jul. 23, 2004.

* cited by examiner

*Primary Examiner*—Frederick C Nicolas
*Assistant Examiner*—Melvin A Cartagena
(74) *Attorney, Agent, or Firm*—Sughrue Mion, PLLC

(57) ABSTRACT

A fluid pump having a pusher with a push wall defining a push outside surface and an inside surface; and a peripheral skirt which extends from the inside surface of the push wall. A pump chamber is provided with an inlet valve and with an outlet valve, a dispensing orifice via which the fluid is dispensed, a main piston, and a differential piston that is mounted to move in the pump chamber in response to variation in the pressure. The differential piston is mounted to move away from the push wall when the pressure increases in the pump chamber; the pusher and the differential piston being mounted to move along an actuating axis that extends substantially perpendicularly to the push wall. The differential piston is formed integrally with an inlet valve moving member that co-operates with an inlet valve seat.

12 Claims, 4 Drawing Sheets

FLUID DISPENSER MEMBER

CROSS REFERENCE TO RELATED APPLICATION

This application claims the benefit under 35 U.S.C. §119 (e) of pending U.S. provisional patent application Ser. No. 60/561,510, filed Apr. 13, 2004, and priority under 35 U.S.C. §119(a)-(d) of French patent application No. FR-03.15194, filed Dec. 22, 2003.

TECHNICAL FIELD

The present invention relates to a fluid dispenser pump that is generally designed to be associated with a fluid reservoir so as to constitute therewith a fluid dispenser. It is a dispenser member that is generally actuated manually by means of a user's finger. The fluid is dispensed in the form of a sprayed stream of fine droplets, a continuous trickle, or a dollop of fluid, in particular for viscous fluids, such as cosmetic creams. Such a fluid dispenser member can, in particular, be used in the fields of perfumes, cosmetics, or indeed pharmaceuticals, for dispensing fluids of various viscosities.

The present invention relates more particularly but not exclusively to a type of dispenser member that can be referred to as a "pusher-pump". That name can be explained by the fact that the dispenser member comprises a pusher that not only forms a dispensing orifice but also defines a portion of a fluid chamber inside which fluid is selectively put under pressure. When the dispenser member is a pump, that chamber is a pump chamber. A particularity of such a pusher-pump lies in the fact that an inside surface of the pusher, which surface is substantially cylindrical in general shape, serves as a leaktight slide cylinder for a piston that moves in leaktight contact inside said cylinder, thereby selectively unmasking the dispensing orifice. In general, the piston is a piston of the differential type which moves in response to variation in the pressure of the fluid inside the chamber. The differential piston should be distinguished from the main piston which is caused to move by actuating the pusher. Thus, such a pusher-pump includes a differential piston and a main piston, which pistons can move in leaktight contact in respective cylinders. The main cylinder for the main piston can also be formed by the pusher.

BACKGROUND OF THE INVENTION

That applies in particular in the pump described in Document WO 97/23304. The pusher has a push wall on which pressure is exerted by means of a finger for the purpose of actuating the pusher. In addition, the pusher has a skirt that extends downwards from the push wall. Said skirt forms a first leaktight slide cylinder for a differential piston and a main second cylinder for the main piston of the pump. The differential piston is dissociated from the main piston. The differential piston is urged away from the push wall by a spring that serves both as a return spring and as a precompression spring. The slide cylinder for the differential piston is provided with an outlet duct that leads to a nozzle received in a recess formed in the skirt of the pusher. The nozzle forms a dispensing orifice via which the fluid is discharged from the dispenser member. In addition, the recess formed by the skirt is provided with a swirl system which co-operates with the nozzle to entrain the fluid in a swirling movement before it is discharged through the dispensing orifice. The swirl system is conventionally made up of one or more tangential swirl channels opening out into a swirl chamber accurately centered on the dispensing orifice. The swirl system is in the form of a network recessed into the recess in the skirt. The recessed network is then associated with the separate nozzle that comes to isolate the swirl channels and the chamber. Thus, the slide cylinder of the differential piston is in the form of a cylindrical surface interrupted only at the outlet channel. When the pusher is pressed, the main piston rises up inside the main cylinder of the pusher, thereby causing the differential piston to move by sliding in leaktight manner inside the differential cylinder. That causes the spring to be compressed: the differential piston then moves upwards towards the push wall of the pusher. The active sealing lip of the differential piston, which lip is directly in contact with the fluid, slides in the bottom portion of the cylinder that is situated below the outlet channel. As soon as the differential piston reaches the outlet duct, the fluid put under pressure in the chamber is delivered from the chamber through said duct and reaches the nozzle, where it is swirled and discharged through the dispensing orifice.

The pump of Document WO 97/23304 is made up of five essential component elements, namely a body designed to be associated with a fluid reservoir, the pusher, a ball forming an inlet valve member, the differential piston, and the nozzle. The body forms the main piston.

U.S. Pat. No. 4,050,613 also describes a pump comprising a pusher, a body fixedly secured by a ring at a recipient opening and a differential piston slidingly mounted within the pusher and on the body in response to a pressure variation. The body, the pusher and the differential piston together form a chamber. When the pressure increases within the chamber, the differential piston moves away from the pusher. Besides, the inlet valve of the chamber is formed by a flap valve able to be deformed when the chamber is under depression. This valve is formed by an additional part to be mounted on the body. The preamble of claim 1 is based on this document.

SUMMARY OF THE INVENTION

An object of the present invention is to improve the pump disclosed in U.S. Pat. No. 4,050,613, namely in decreasing the number of the constitutive parts and in optimizing the general operating of the pump.

In a first aspect, the present invention proposes a fluid pump comprising: a pusher comprising: a push wall defining a push outside surface and an inside surface; and a peripheral skirt which extends from the inside surface of the push wall; a pump chamber provided with an inlet valve and with an outlet valve; a dispensing orifice via which the fluid is dispensed; a main piston for causing the volume of the pump chamber to vary; and a differential piston that is mounted to move in the pump chamber in response to variation in the pressure in the pump chamber; the pusher and the differential piston being mounted to move along an actuating axis which extends substantially perpendicularly to the push wall; the differential piston being mounted to move away from the push wall when the pressure increases in the pump chamber, said pump being characterized in that the differential piston is formed integrally with an inlet valve moving member which co-operates with an inlet valve seat.

In the above-mentioned prior art, the inlet valve is formed by an independent ball or a flap resting on a seat. It is possible, in particular, to form the inlet valve moving member with the differential piston because said differential piston moves away from the push wall when the pressure increases in the pump chamber. This contributes to the inlet valve moving member moving towards the inlet valve seat.

In another aspect of the invention which can be implemented independently or in combination with the above-mentioned characteristics of the invention, the push wall forms a wall element of the pump chamber. In the prior-art document, the space formed between the differential piston and the push wall is a dead space that does not fulfill any function. By extending the pump chamber to the push wall, the volume formed by the pusher is optimized. There is no longer any dead volume, such that the size of the pusher, and thus of the pump, can be reduced.

In another aspect of the invention which can also be implemented independently or in association with the above-mentioned characteristics, the differential piston is provided with at least one fluid-passing hole. The fluid-passing holes enable the pump chamber to be extended to the push wall. Furthermore, this enables the displacement of the differential piston to be reversed relative to the above-mentioned prior-art document. The differential piston can thus move away from the push wall when the pressure increases in the pump chamber.

In an advantageous embodiment, the skirt of the pusher has an inside surface forming a leaktight slide cylinder, the dispensing orifice being formed at said slide cylinder, the differential piston having at least one sealing lip in leaktight sliding contact inside said cylinder, so as to unmask said dispensing orifice when the differential piston moves away from the push wall. It should be noted that the sealing lip of the follower piston moves into the top portion of the cylinder situated between the dispensing orifice and the push wall. In the above-mentioned prior art, the opposite applies. Furthermore, the dispensing orifice is formed directly inside the slide cylinder and not in a separate nozzle.

In another advantageous embodiment, the differential piston has a disk substantially perpendicular to the actuating axis, said disk being mounted to move away from the push wall when the pressure increases in the pump chamber, said disk having a pressure surface disposed facing the inside surface of the push wall, said disk being provided with at least one through fluid-passing hole so that a portion of the pump chamber is defined between the push wall and the disk, the disk having an outer periphery which forms at least one sealing lip in leaktight sliding contact inside the skirt of the pusher.

In another advantageous aspect of the invention which can be implemented independently of the above-mentioned characteristics, the differential piston is formed integrally with the main piston, said main piston having a sealing lip in leaktight sliding contact inside a main cylinder. This is not the case in the above-mentioned prior-art document, in which the main piston is formed by a body that is independent from the differential piston.

According to an advantageous characteristic of the invention, the pump further comprises a body designed to be associated with a fluid reservoir, and a return spring bearing at one end against the body and at the other end against the differential piston. The return spring is advantageously formed integrally with the differential piston or with the body.

In another advantageous aspect of the invention, the inside surface of the skirt forming the slide cylinder of the pusher is provided with a swirl system centered on the dispensing orifice, said system being formed integrally in the skirt of the pusher. This characteristic is particularly advantageous in combination with the fact that the differential piston moves away from the push wall when the pressure increases in the pump chamber. The inside surfaces of the pusher forming the slide cylinder of the differential piston are generally made of an injection molded plastics material. For this purpose, a mold is used that is made up of a plurality of elements. One of said elements forms in particular a core for forming the inside surface of the pusher. In the present invention, said core must form not only the slide cylinder, but also the swirl system. Since the swirl system extends by forming a portion that is recessed into the slide cylinder of the differential piston, the core must form a corresponding negative imprint that projects outwards. Also, while the core is being withdrawn, during unmolding, the projecting imprint must be withdrawn by force. The projecting imprint must therefore come out of the recessed portion that it has formed, and must move along a bottom portion of the slide cylinder. Given that the plastics material can creep, forcing the projecting imprint through marks the slide cylinder only very little. However, marking is not impossible. By ensuring that the differential piston moves away from the push wall, this necessarily signifies that the sealing lip of the differential piston which is in contact with the fluid moves into the top portion of the cylinder situated between the swirl system and the push wall. Consequently, the top portion, which has not been subjected to the withdrawal of the core, is necessarily intact. The differential piston is thus guaranteed to slide in a cylinder whose surface quality is perfect, and is in no way damaged by the molding core which served to form the swirl system.

In another advantageous embodiment of the invention, the differential piston is formed by a piston member which is further provided with a valve rod which extends centrally and axially away from the pressure surface, said rod co-operating with a valve seat for forming the inlet valve. The piston member may also be provided with a bushing which extends concentrically around the valve rod, said bushing forming the main piston in the form of a sealing lip. Thus, an integral part, namely the piston member, forms simultaneously the differential piston, the main piston, and the moving member of the inlet valve. This architecture is different from that of the above-mentioned prior-art document.

According to another feature, the inlet valve rod is axially guided in a sleeve (116).

BRIEF DESCRIPTION OF THE DRAWINGS

The invention is described more fully below with reference to the accompanying drawings which show embodiments of the invention by way of non-limiting example.

In the figures.

DETAILLED DESCRIPTION OF THE INVENTION

Figure 1:
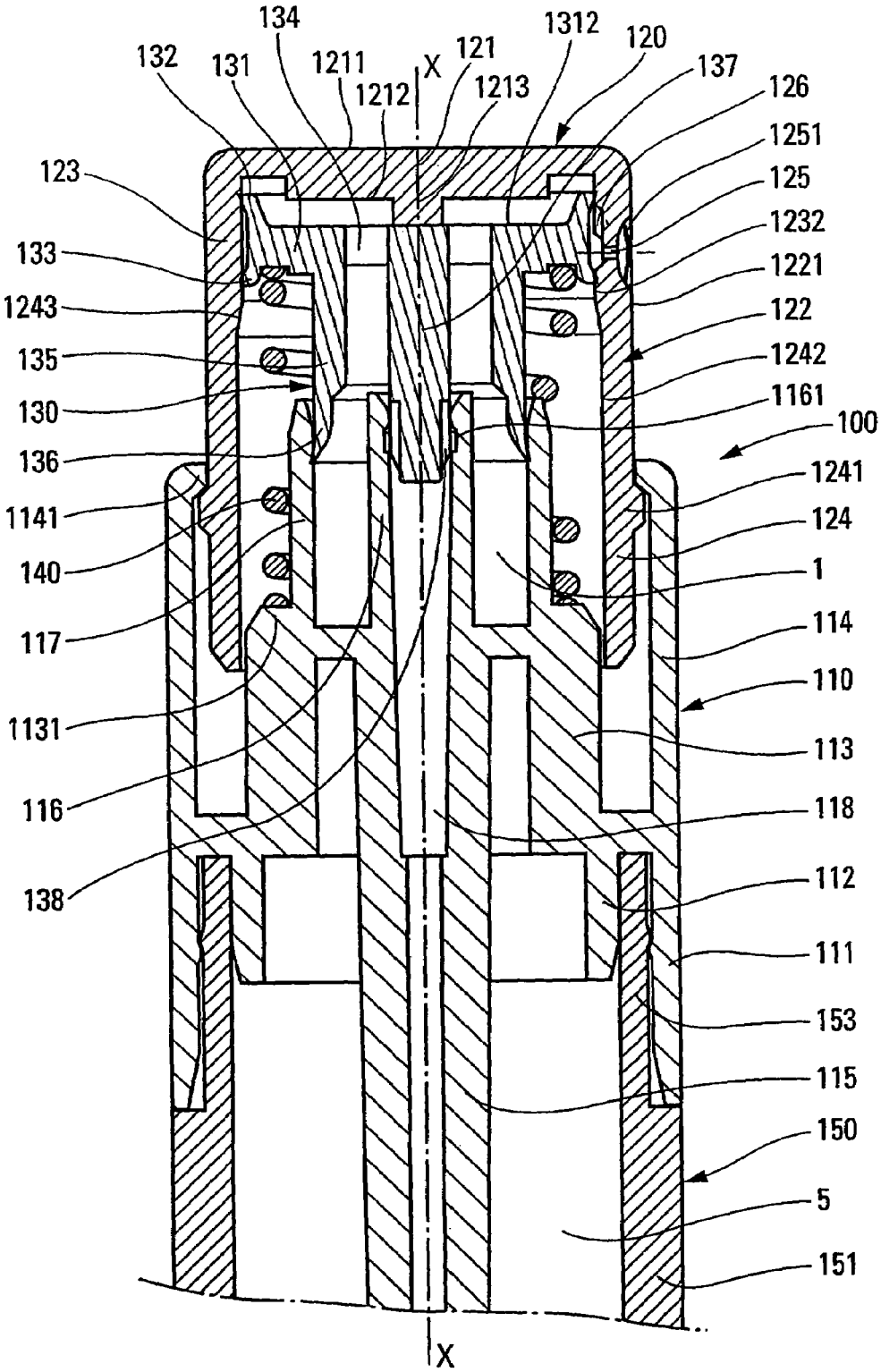
FIG. 1 is a vertical section view through a first embodiment of the dispenser member in the rest state, associated with a fluid reservoir that is shown merely in part.
Figure 2:
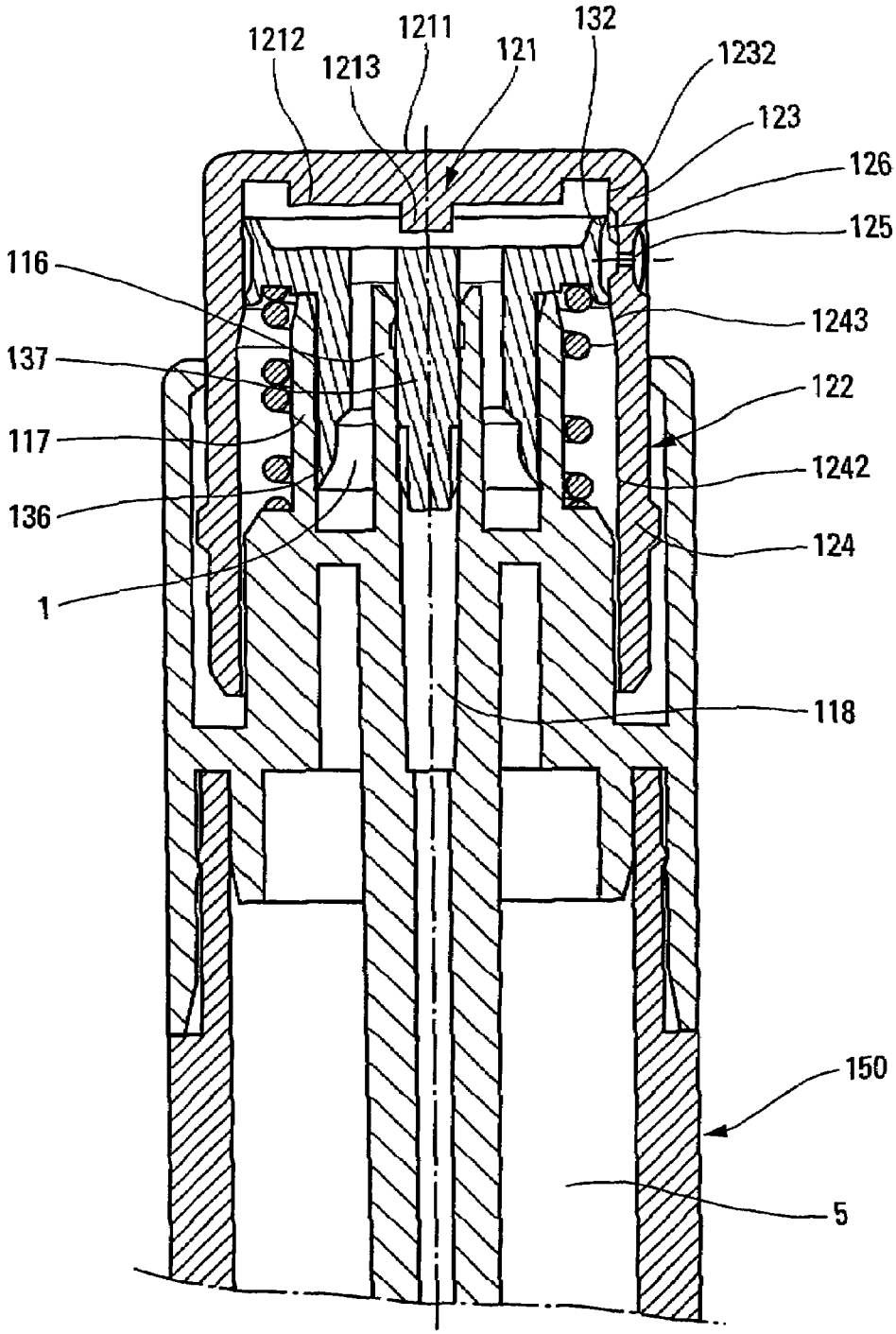
FIG. 2 is a view similar to FIG. 1, in the actuated position.

The dispenser member of the first embodiment shown in FIGS. 1 and 2 is a pump which is associated with a receptacle 150 having a body 151 internally defining a fluid reservoir 5. At its top end, the body 151 is provided with an opening in the form of a neck 153, which serves for fixing the dispenser member of the invention.

The pump comprises three component elements, namely a body 110, a pusher 120, and a piston member 130. The dispenser member further comprises spring means in the form of a coil spring 140. The body, the pusher, and the piston member are preferably made of molded plastics material. The pump has a pump chamber 1.

The body 110 is provided with a fixing ring 111 which co-operates with the neck 153 to fix the member to the receptacle 150. The ring 111 is in engagement with the outside of the neck 153. In addition, the body forms a self-sealing lip 112 in leaktight engagement with the inside wall of the neck 153. The body 111 also forms a guide band 114 which can advantageously extend in alignment with the ring 111. The top end of the guide band 114 is provided with an inwardly-extending rim 1114. The body 110 also forms a bushing 113 which extends concentrically inside the guide band 114. Thus, an annular gap is formed between the band 114 and the bushing 113. At its top end, the bushing 113 has a shoulder 1131 which serves as an abutment surface for the spring 140. The bushing 113 is extended upwards by forming a main cylinder 117 which internally defines a leaktight sliding surface whose function is described below. The body also forms a dip tube 115 which extends inside the receptacle 150. At its top end, the dip tube 115 is extended by an inlet sleeve 116 which forms an inlet valve profile or seat 1161. An inlet duct 118 passes through the dip tube 115 and through the sleeve 116. The inlet sleeve 116 extends concentrically inside the main cylinder 117, so that an annular space is formed between them.

The body 110 is axially and circularly symmetrical about an axis X that extends longitudinally at the axial center of the inlet duct 118.

This is a particular design for a particular body of a dispenser member in a first embodiment of the invention. Naturally, the body can have characteristics other than the above-described characteristics without going beyond the ambit of the invention.

The pusher 120 forms a dispenser head for the dispenser member. The pusher 120 comprises a push wall 121 and a peripheral skirt 122 which extends downwards from the outer periphery of the push wall. Thus, the pusher 120 is in the general shape of an upside-down cup for which the push wall forms the end-wall and the skirt forms the cylindrical side wall. However, the skirt is not necessarily cylindrical in shape. It can be frustoconical or rounded in section.

The push wall 121 has a push outside surface 1211 on which it is possible to push with one or more fingers. In addition, the push wall 121 has an inside surface 1212 which advantageously forms an abutment stud 1213.

The skirt 122 has a dispensing top wall 123 and a guide bottom wall 124. At its top end, the dispensing wall 123 is connected to the outer periphery of the push wall 121. The dispensing wall 123 has an outside surface 1221 and an inside surface 1232. The inside surface 1232 is preferably circularly cylindrical and defines a slide cylinder as explained below. In addition, the dispensing wall 123 is provided with a through dispensing orifice 125 which extends from the inside surface to the outside surface. The dispensing orifice 125 can open out into a dispensing dish 1251 on the outside surface.

According to an advantageous characteristic of the invention, the inside wall 1232 of the dispensing wall 123 is provided with a swirl system 126 which makes it possible to rotate fluid in the form of a swirl whose eye is centered on the dispensing orifice. Thus, the dispensing wall 123, which is advantageously formed integrally with the push wall 121 and with the guide wall 124, is provided with a through dispensing orifice and has an inside surface provided with a swirl system.

The outside surface of the guide wall 124 is provided with an abutment bead 1241 serving to co-operate with the inwardly-extending rim 1141 of the guide band 114. The guide wall 124 is disposed in the annular gap formed between the guide band 114 and the bushing 113. The abutment bead 1241 makes it possible to secure the pusher to the body, which can thus only move axially over a maximum stroke determined by the distance between the bottom end of the guide wall 124 and the end wall of the annular gap formed between the band 114 and the bushing 113.

In this embodiment, the piston member 130 comprises a main piston 136 engaged to slide in leaktight manner in the main cylinder 117, and a differential piston formed by two lips 132 and 133 in leaktight sliding contact in the cylinder formed by the inside surface 1232 of the dispensing wall 123. The piston member 130 is advantageously formed integrally as a single piece. The lips 132 and 133 extend one above the other with spacing greater than the axial extent of the swirl system 126. In the rest position, shown in FIG. 1, the top lip 132 is in contact with the inside surface 1232 above the swirl system 126, while the bottom lip 133 comes into contact with the inside surface 1232 below the swirl system 126. Thus, the swirl system cannot communicate with the inside of the pusher except at the space formed between the two lips 132 and 133. This is the rest position into which the piston member 130 is urged against the push wall 121 by the spring 140, which bears at one end against the shoulder 1131 and at the other end under a disk 131 formed by the piston member 130. In addition, the two lips 132 and 133 are formed on the outer periphery of the disk 131. At its center, the disk comes into abutment against the abutment stud 1213 formed at the inside surface 1212 of the push wall 121. It can be considered that the differential piston is formed by the disk 131 that forms the two lips 132 and 133. The piston member 130 also forms an axial central rod 137 that extends from the disk 131 away from the push wall 121. The axial rod 137 is engaged in part inside the inlet sleeve 116 formed by the body 110. The rod 137 forms a valve profile 138 serving to co-operate with the corresponding profile 1161 formed by the sleeve 116. In other words, the rod 137 in co-operation with the sleeve 116 forms an inlet valve for a pump chamber 1, as explained below. In addition, the piston member 130 forms a piston bushing 135 at the bottom end of which the main piston 136 is formed. The piston bushing 135 extends concentrically around the axial rod 137, so as to define between them an annular duct that extends through the disk 131 via fluid-passing holes 134.

The body 110, the pusher 120, and the piston member 130 together form a pump chamber 1 that extends continuously between the main cylinder 117 and the sleeve 116, between the piston bushing 135 and the axial rod 137, through the holes 134, and between the disk 131 and the inside surface 1212 of the push wall 121. Thus, the top surface of the disk 131 and the inside surface 1212 form wall elements for the pump chamber 1. In the rest position, shown in FIG. 1, the spring 140 pushes the piston member 130 into abutment against the push wall 121. The inlet valve formed by co-operation between the axial rod 137 and the sleeve 116 is open. The two lips 132 and 133 of the differential piston are in contact with the cylinder formed by the inside surface 1232 of the actuating wall 123 as shown in dashed lines in FIG. 3*a*.

When a force is exerted on the push outside surface 1211 of the push wall 121, the pusher is caused to move axially relative to the body 110. Since the piston member is in abutment against the push wall, the piston member is pushed by the pusher. In a first stage, movement of the pusher causes the inlet valve to be closed: the axial rod 137 is engaged more deeply into the sleeve 116 until leaktight sliding contact is achieved between the sleeve and the rod. Thus, the pump chamber 1 is isolated from the reservoir 5. As from then, the fluid in the pump chamber 1 is put under pressure. Because the fluid is incompressible, the total working volume of the pump chamber remains constant. But since the main piston 136 penetrates into the cylinder 117, thereby reducing the volume of the bottom portion of the chamber, a new volume must be created. This is made possible by the fact that the differential piston moves away from the push wall 121. This causes the lips 132 and 133 to slide inside the dispensing wall 123. The lips thus move until the top lip 132 reaches the swirl system 126. This is shown in FIG. 2. Whereupon, the fluid under pressure in the pump chamber finds an outlet passageway through the swirl system and through the dispensing orifice. The position of the top lip 132 is shown in dashed lines in FIG. 3*b*. The passageway thus remains open so long as the pressure inside the chamber can overcome the force of the spring 140. As soon as the pressure inside the chamber decreases below a certain threshold, the spring 140 pushes the differential piston back towards the rest position shown in FIG. 3*a*. The swirl system and the dispensing orifice are then isolated once again from the pump chamber.

It can be noted that the top lip 132 is directly in contact with the fluid, whereas the bottom lip is not directly in contact with the fluid. Thus, the top lip slides in the top portion of the cylinder defined between the push wall and the swirl system. Said top portion offers a surface of quality better than the quality of the surface of the bottom portion that extends below the swirl system, which portion might be damaged by the molding core being removed.

Figure 3A:
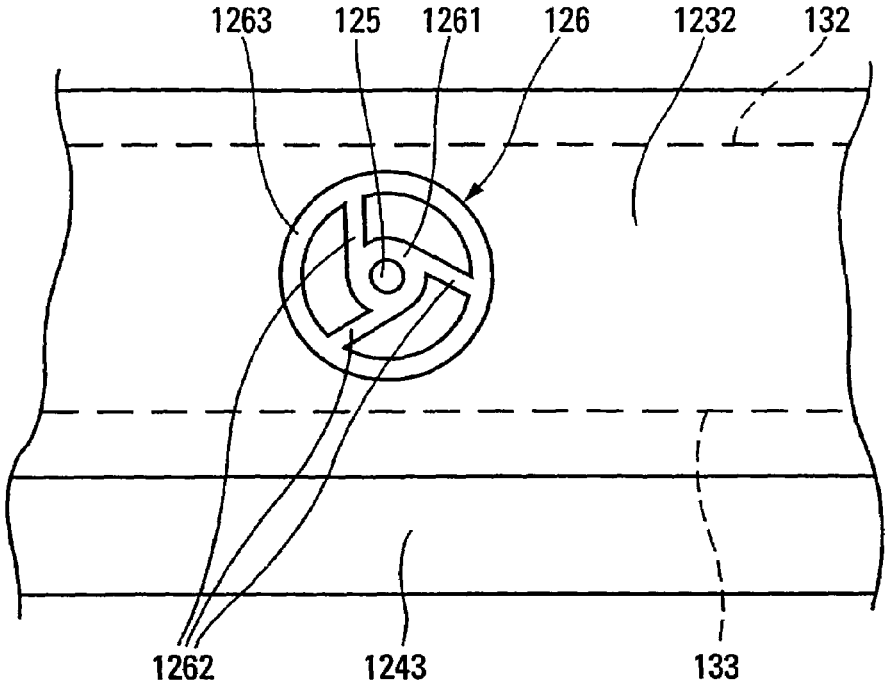
FIGS. 3*a* and 3*b* are diagrammatic views of the inside surface of the dispensing wall provided with a swirl system of the invention, respectively in the rest position and in the actuated position.
Figure 3B:
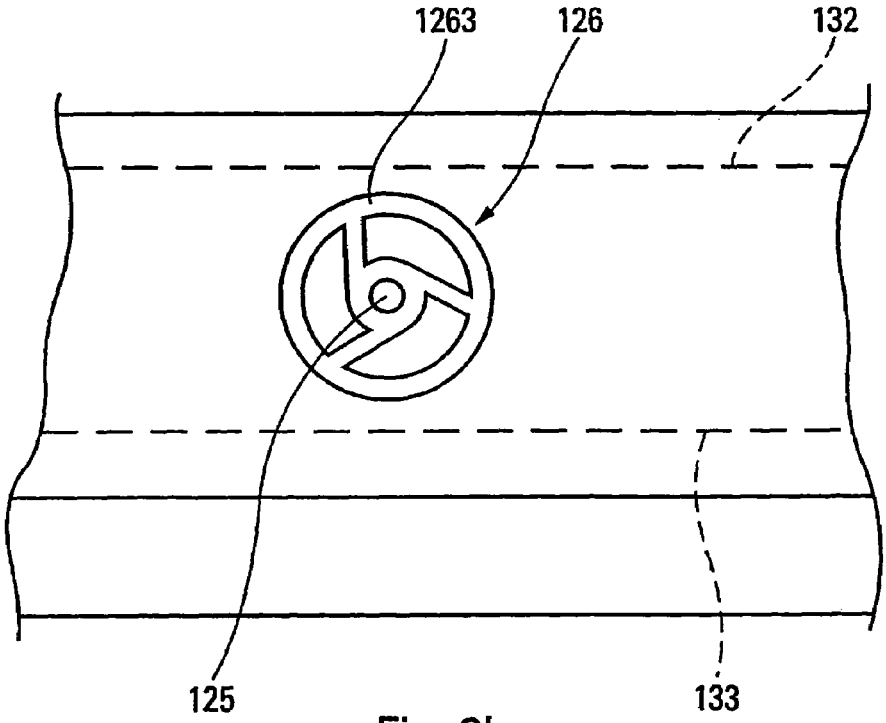

FIGS. 3*a* and 3*b* show a particular non-limiting embodiment for the swirl system formed in the dispensing wall of the dispensing member of the invention. Said swirl system comprises at least one tangential swirl channel 1262. In the figures, there are three tangential channels disposed at uniform angular spacing. The swirl system further comprises a central swirl chamber 1261 that is accurately centered relative to the dispensing orifice 125. Optionally, the swirl system may further comprise a peripheral feed ring 1263 which makes it possible to feed all of the swirl channels 1262. If necessary, the swirl system can be reduced to a single swirl channel associated with the central swirl chamber.

An advantageous characteristic of the invention lies in the fact that the piston member 140 is urged against the push wall 121 and moves under the effect of the increase in pressure inside the pump chamber away from said push wall. This is made possible in particular by means of the fluid-passing holes 134 provided through the disk 131 forming the differential piston. It is thus possible to say that the push wall defines a wall element of the pump chamber.

The differential piston moving away from the push wall in this way, in association with a swirl system formed in the dispensing wall is advantageous for the purposes of unmolding, given that the top lip 132 slides in leaktight manner over the top portion of the slide cylinder, which top portion cannot then be damaged by withdrawing the molding core forming the "negative" imprint that served to mold the swirl system.

It can also be noted that the rest position is reached when the abutment bead 1241 formed by the guide wall 124 is in abutment under the inwardly-extending rim 1141.

In addition, axial guiding of the pusher is guaranteed firstly by the guide wall 124 being guided axially between the band 114 and the bushing 113, and secondly by the piston bushing 135 and the axial rod 137 being engaged respectively in the main cylinder 117 and in the inlet sleeve 116.

Figure 4B:
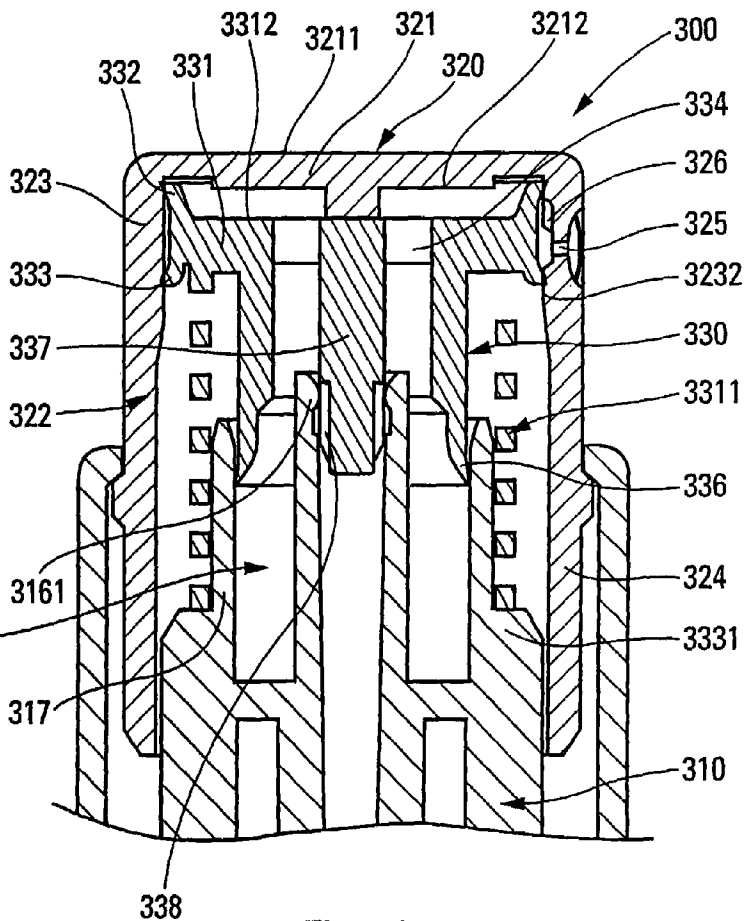
FIGS. 4*a* and 4*b* are vertical section views through respective ones of two variant embodiments of the dispenser member.
Figure 4A:
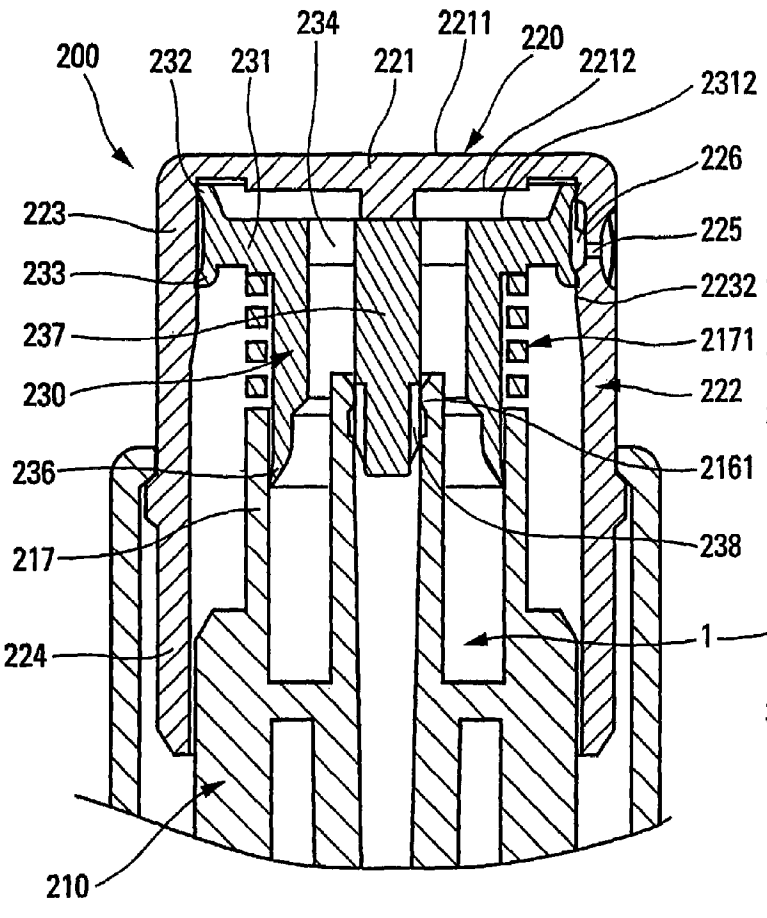

FIGS. 4*a* and 4*b* show respective variants of the embodiment of FIGS. 1 and 2.

In the variant shown in FIG. 4*a*, the return and precompression spring is formed integrally with the body 210 and bears the numerical reference 2171. The spring extends in alignment with the main cylinder 217 and comes into abutment under the disk 231 which forms the differential piston with its two lips 232 and 233. The spring 2171 thus extends concentrically about the bushing 230 that forms the main piston 236. Apart from the return spring, the dispenser member 200 of FIG. 4*a* can be identical to the dispenser member of FIGS. 1 and 2.

In the embodiment 4*b*, the dispenser member 300 includes a return spring 3311 which is formed integrally with the piston member 330. More precisely, the spring 3311 extends from the bottom face of the disk 331. It comes into abutment at its bottom end against the shoulder 3331 formed by the body 310. Apart from the particular form of the spring, the dispenser member 300 may be identical to the dispenser member of FIGS. 1 and 2.

In the variant embodiments of FIGS. 4*a* and 4*b*, the dispenser member comprises three component elements only, namely a body, a pusher, and a piston member, since the return and precompression spring is integral either with the body or with the piston member.

The invention claimed is:

1. A fluid pump (100; 200; 300) comprising:

a pusher (120; 220; 320) comprising: a push wall (121; 221; 321) defining a push outside surface (1211; 2211; 3211) and an inside surface (1212; 2212; 3212); and a peripheral skirt (122; 222; 322) which extends from the inside surface of the push wall;

a pump chamber (1) provided with an inlet valve and with an outlet valve;

a dispensing orifice (125; 225; 325) via which the fluid is dispensed;

a main piston (136; 236; 336) for causing the volume of the pump chamber to vary; and a differential piston (131, 132, 133; 231, 232, 233; 331, 332, 333) that is mounted to move in the pump chamber in response to variation in the pressure in the pump chamber, the differential piston being mounted to move away from the push wall when the pressure increases in the pump chamber;

the pusher and the differential piston being mounted to move along an actuating axis (X) which extends substantially perpendicularly to the push wall; and wherein the differential piston is formed integrally with an inlet valve moving member (138; 238; 338) which cooperates with an inlet valve seat (1161; 2161; 3161); and the inside surface of the skirt forms both a slide cylinder for the differential piston and a swirl system centered on the dispensing orifice, said swirl system being formed as a one-piece integral construction with the skirt of the pusher.

2. A fluid pump according to claim 1, in which the differential piston is formed by a piston member (130; 230; 330) which is further provided with a valve rod (137; 237; 337) which extends centrally and axially away from the pressure surface, said rod cooperating with a valve seat for forming the inlet valve.

3. A fluid pump according to claim 2, in which the piston member is further provided with a bushing (135) which extends concentrically around the valve rod, said bushing forming the main piston in the form of a sealing lip.

4. A fluid pump according to claim 2, in which the inlet valve rod is axially guided in a sleeve (116).

5. A fluid pump according to claim 1, in which the differential piston has a disk (131; 231; 331) substantially perpendicular to the actuating axis, said disk being mounted to move away from the push wall when the pressure increases in the pump chamber, said disk having a pressure surface (1312; 2312; 3312) disposed facing the inside surface (121; 2212; 3212) of the push wall, said disk being provided with at least one through fluid-passing hole (134; 234; 334) so that a portion of the pump chamber is defined between the push wall and the disk, the disk having an outer periphery which forms at least one sealing lip (132, 133; 232, 233; 332, 333) in leaktight sliding contact inside the skirt of the pusher.

6. A fluid pump according to claim 1, in which the differential piston is formed integrally with the main piston, said main piston having a sealing lip in leaktight sliding contact inside a main cylinder.

7. A fluid pump according to claim 1, further comprising a body (110, 210; 310) designed to be associated with a fluid reservoir (5), and a return spring (140; 2171; 3311) bearing at one end against the body and at the other end against the differential piston.

8. A fluid pump according to claim 7, in which the return spring is formed integrally with the differential piston or with the body.

9. A fluid pump according to claim 7, in which the body forms an the inlet valve seat (1161; 2161; 3161), a main cylinder (117; 217; 317) for the main piston, a high abutment (1141) for the pusher, axial guide means (113, 114) for the pusher, fixing means (111) for fixing to a reservoir, and a dip tube (115).

10. A fluid pump according to claim 1, in which the push wall forms a wall element of the pump chamber.

11. A fluid pump according to claim 1, in which the differential piston is provided with at least one fluid-passing hole (134; 234; 334).

12. A fluid pump comprising:

a pusher comprising: a push wall defining a push outside surface and an inside surface; and a peripheral skirt which extends from the inside surface of the push wall;

a pump chamber provided with an inlet valve and with an outlet valve;

a dispensing orifice via which the fluid is dispensed;

a main piston for causing the volume of the pump chamber to vary; and a differential piston that is mounted to move in the pump chamber in response to variation in the pressure in the pump chamber, the differential piston being mounted to move away from the push wall when the pressure increases in the pump chamber;

the pusher and the differential piston being mounted to move along an actuating axis which extends substantially perpendicularly to the push wall; and wherein the differential piston is formed integrally with an inlet valve moving member which co-operates with an inlet valve seat; and wherein the skirt of the pusher has an inside surface (1232; 2232; 3232) forming a leaktight slide cylinder, the dispensing orifice being formed at said slide cylinder, the differential piston having at least one sealing lip (132, 133, 232, 233; 332, 333) in leaktight sliding contact inside said cylinder, so as to unmask said dispensing orifice when the differential piston moves away from the push wall.

* * * * *